United States Patent [19]

Ihara

[11] Patent Number: 4,915,389

[45] Date of Patent: Apr. 10, 1990

[54] GOLF BALLS

[75] Inventor: Keisuke Ihara, Tokyo, Japan

[73] Assignee: Bridgestone Corporation, Tokyo, Japan

[21] Appl. No.: 271,837

[22] Filed: Nov. 16, 1988

[51] Int. Cl.[4] ..... A63B 37/14

[52] U.S. Cl. ..... 273/232; 273/213

[58] Field of Search ..... 273/232, 213, 183 C; 40/327

[56] References Cited

U.S. PATENT DOCUMENTS 4,560,168 12/1985 Aoyama ..... 273/235 R 4,762,326 8/1988 Gobush ..... 273/232

4,765,626 8/1988 Gobush ..... 273/232

4,772,062 9/1988 Gobush ..... 273/232

*Primary Examiner*—George J. Marlo

*Attorney, Agent, or Firm*—Sughrue, Mion, Zinn, Macpeak & Seas

[57] ABSTRACT

A golf ball has many dimples formed on its spherical surface, provided that these dimples are existent on all great circles depicted on the spherical surface, whereby the aerodynamic properties are improved and sufficiently uniformized over the full spherical surface. All of dimples are positioned on the great circles so that no land portion defining a circumferential parting line is present. The number of dimples is increased to 272 in one embodiment and 482 in another.

8 Claims, 3 Drawing Sheets

GOLF BALLS

BACKGROUND OF THE INVENTION

1. Field of the Invention

This invention relates to golf balls. More particularly it relates to a golf ball evenly provided at its spherical surface with dimples as much as possible for improving the aerodynamic properties to enhance and stabilize the flight performance of the ball.

RELATED ART STATEMENT

The formation of dimples on the spherical surface of the golf ball is frequently carried out by injection molding of a synthetic resin material in a split mold divided into a pair of up and down or left and right segments, or by shaping a spherical body previously covered with an uncured outer cover layer in the same split mold as mentioned above under a pressure through heating.

When the dimples are formed by such a method, however, a ring-like island portion containing no dimple or a so-called parting line is necessarily produced in the golf ball at a position corresponding to the joint portion of the split mold. This parting line injures the aerodynamic properties of the golf ball and obstructs the uniformization of the aerodynamic properties on the full spherical surface of the golf ball.

Therefore, it is usually attempted to make uniform the aerodynamic properties of the golf ball by intentionally forming plural ring-like island portions on the spherical surface of the golf ball. However, the arrangement of dimples is actually designed by taking a regular polygon as a basic form, so that the number of ring-like island portions is only increased by about 3 to 10. Consequently it is impossible to attain the sufficient uniformization of the aerodynamic properties. On the other hand, there is a problem of degrading the aerodynamic properties of the golf ball as the number of ring-like island portions increases.

SUMMARY OF THE INVENTION

It is an object of the invention to provide a golf ball having no parting line by forming dimples without using the split mold, which improves the aerodynamic properties of the ball and sufficiently uniformizes these properties over the full spherical surface of the ball.

According to the invention, there is the provision of a golf ball having a plurality of dimples formed in its spherical surface, characterized in that said dimples are arranged on all great circles depicted on said spherical surface.

DESCRIPTION OF THE PREFERRED EMBODIMENTS

The golf ball according to the invention can be produced for a short time by rendering a spherical body previously covered with an outer cover layer into a high-accuracy sphere through, for example, centerless grinding and then forming dimples of predetermined size on the surface of the sphere according to the predetermined arrangement through an end milling cutter or other tool without considering the joint position of the split mold. In the thus obtained golf ball, the dimples are always existent on all of great circles depicted on the spherical surface of the ball. In other words, no ring-like island portion is formed on the spherical surface of the ball. Therefore, in the golf ball according to the invention, there is no fear that the aerodynamic properties are injured by the ring-like island portion. Also, there no fear that the uniformization of aerodynamic properties of the ball is obstructed over the full spherical surface of the ball. Thus, the flying distance is sufficiently increased based on the improvement of the aerodynamic, properties and the uniformization thereof. Further the accidental turning of the flying ball is effectively prevented irrespective of the impact state and the flying state of the ball.

Figure 1:
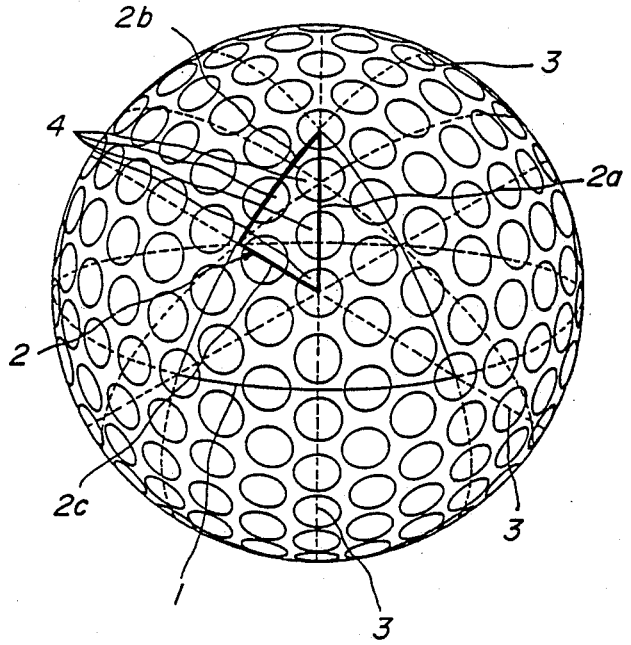
FIGS. 1 to 5 are elevational views of various embodiments of the golf ball according to the invention, respectively.

In FIG. 1 is shown a first embodiment of the golf ball according to the invention in connection with the conventional dimple formation method.

For instance, when a regular icosahedron is taken as a basic form of the golf ball, according to the conventional dimple formation method, each of the spherical triangles 1 formed by projecting the regular icosahedron onto a spherical surface (see a solid line) is divided into six identical spherical standard units 2 (see a thick line frame) each being a spherical triangle. A dimple arrangement determined per one spherical standard unit 2 as a standard dimple pattern is applied to all spherical standard units 2 constituting one spherical triangle 1 and hence all spherical triangles 1 constituting the ball. Therefore, in order to form at least one ring-like island portion capable of acting as a parting line on the golf ball, it is necessary that at least one linear island portion capable of continuously extending over a full circumference of the ball is arranged in the dimple standard pattern.

For this purpose, in order to serve at least one great circle 3 passing through the spherical standard unit 2 among plural great circles depicted on the spherical surface as shown by dotted lines as a part of the parting line, the dimples have hitherto been arranged at positions not crossing with the above great circle 3.

On the contrary, according to the invention, the dimples are directly formed on the spherical surface of the ball, so that there is no necessity for considering the joint position of the split mold. In other words, the formation of the parting line is useless. Therefore, even when the predetermined dimple arrangement for the spherical standard unit 2 is applied as a standard dimple pattern, dimples 4 are arranged so as to cross with all great circles 3 passing through the spherical standard unit 2, so that the dimple arrangement in the spherical standard unit 2 can be made sufficiently dense and uniform as compared with the conventional technique.

In the illustrated embodiment, four circular dimples 4 are arranged on a great circle 3 overlapped with a side 2*a* of the spherical standard unit 2 having a longest length (hereinafter referred to as long side) so as to cross with other seven great circles 3 intersected with the long side 2*a*. On a great circle 3 over-lapped with a side 2*b* of the spherical standard unit 2 having a middle length (hereinafter referred to as middle side) is arranged another circular dimple 4 having a center located on the middle side 2*b* but not crossed with all of the other great circles 3 and slightly crossing with one of the other great circles 3 in addition to the circular dimple 4 located at an intersection between the long side 2*a* and the middle side 2*b*. On a great circle 3 overlapped with a side 2*c* of the spherical standard unit 2 having a shortest length (hereinafter referred to as short side) is arranged another circular dimple 4 having a center located on the short side 2c but not crossed with all of the other great circles 3 and slightly crossing with one of the other great circles 3 in addition to the circular dimple 4 located at an intersection between the long side 2a and the short side 2c. According to the invention, therefore, 272 circular dimples 4 are sufficiently equally arranged over the spherical surface of the golf ball.

In the above illustrated golf ball, no ring-like island portion is formed on the spherical surface of the ball, so that the aerodynamic properties of the ball are improved and sufficiently uniformized over the full spherical surface and consequently accidental turning can effectively be prevented while extending the flying distance.

Among the innumerable great circles depicted on the spherical surface, if one or plural great circles do not cross with the dimples 4 in the one or more spherical standard units 2, such great circles always cross with other dimples 4 located in a spherical standard unit other than the above spherical unit. Therefore, the ring-like island portion never remains in the golf ball according to the invention.

According to the invention, the formation of the above dimples is carried out as follows. At first, a spherical body previously covered with an outer cover layer is shaped into a high accuracy sphere by means of a centerless cutting device. Then, this sphere is placed in a dimple forming device consisting of a vertical table and a dividing table at a perpendicularly crossed point between the pivotable axis line of the vertical table and the pivotable axis line of the dividing table. Then each of these tables is oscillated within a given angle range to oscillate the sphere about its center point in two perpendicularly crossing directions, during which a circular or non-circular dimple is formed on the surface of the sphere through a cutting tool. By successively repeating such a procedure, dimples having the predetermined size can be arranged on the full surface of the sphere in accordance with the predetermined dimple arrangement.

Figure 2:
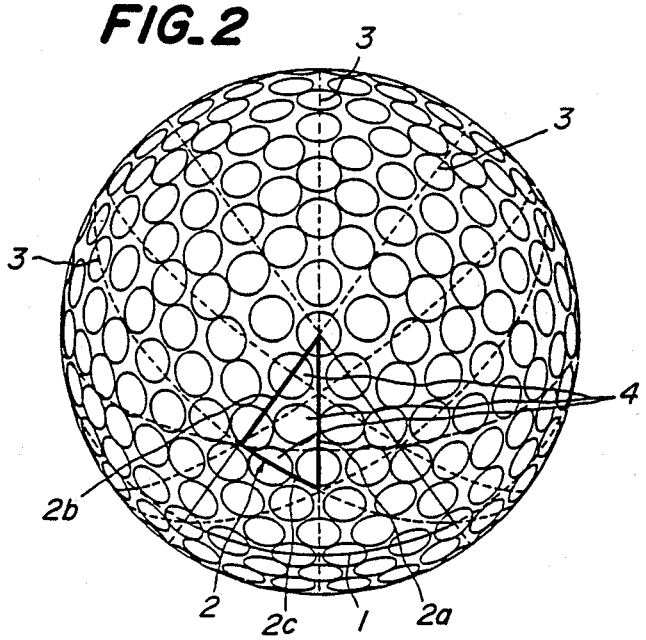

FIG. 2 shows a second embodiment of the golf ball according to the invention. In this case, considering the same spherical standard unit 2 as in FIG. 1, a circular dimple 4 is arranged on a great circle 3 overlapped with the long side 2a so as to slightly cross with the other great circle 3 perpendicularly intersecting with the above great circle 3 on the spherical surface. Another circular dimple 4 is arranged at an intersection between the long side 2a and middle side 2b so as to cross with a great circle 3 overlapped with the middle side 2b. A further circular dimple 4 is arranged on the great circle 3 overlapped with the middle side 2b to cross with a great circle 3 passing through a mid-portion of the middle side 2b and another circular dimple 4 is arranged on the great circle 3 overlapped with the middle side. 2b so as to cross with two great circles 3 passing through an intersection between the middle side 2b and the short side 2c. Further, a circular dimple 4 is arranged on the great circle 3 overlapped with the short side 2c so as to cross with a great circle 3 perpendicularly intersecting with the long side 2a on the spherical surface and another circular dimple 4 is arranged in the spherical standard unit 2 so as to cross with a great circle 3 acutely intersecting with the long side 2a on the spherical surface. Thus, 372 circular dimples are uniformly and densely arranged over the full surface of the sphere.

In the second embodiment of the golf ball, the area of all circular dimples 4 occupied in the spherical surface becomes large and the arranging density thereof becomes high as compared with the first embodiment, so that the aerodynamic properties of the golf ball and the uniformization thereof are more improved.

Figure 3:
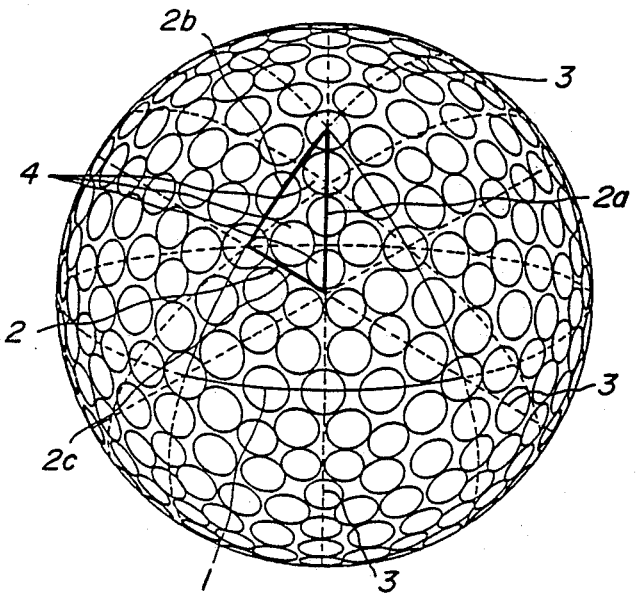
Figure 4:
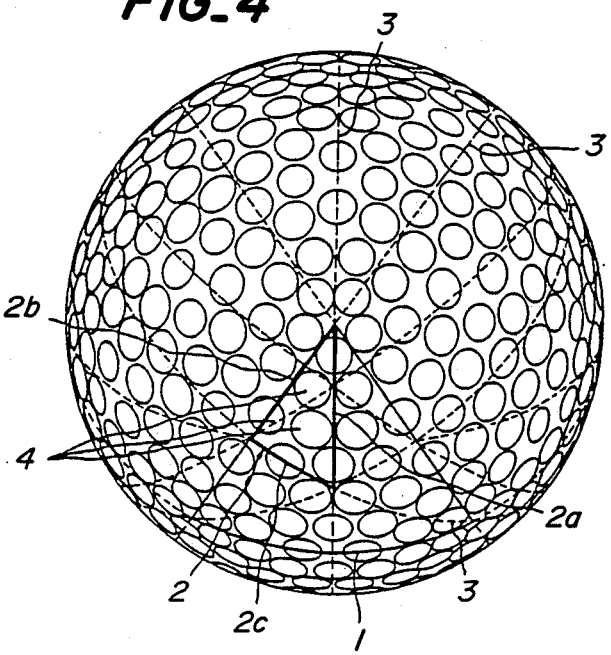
Figure 5:
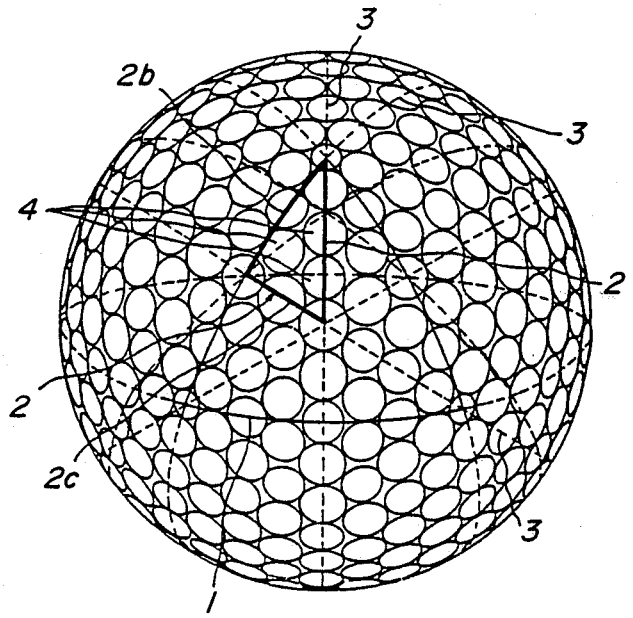

FIGS. 3 to 5 show the other embodiments of the golf ball according to the invention, respectively. In these embodiments, at least either the arranging position of the circular dimple 4 and the size of the circular dimple 4 to be arranged per the spherical standard unit 2 is changed from the aforementioned embodiments, whereby the number of circular dimples 4 is increased to 402 (FIG. 3), 480 (FIG. 4) and 482 (FIG. 5), respectively.

According to these embodiments, the aerodynamic properties of the golf ball and the uniformization thereof are further improved.

Although the invention has been described with reference to the above embodiments, if the circular dimple takes a minimum size (about 2 mm) capable of developing the function of the dimple itself, the number of circular dimples can be further increased on the spherical surface as compared with the above embodiments. In this way, the area of all circular dimples occupied in the spherical surface can be further increased and also the arranging density of the circular dimple can be further enhanced.

According to the invention, only the non-circular dimple may be arranged on the spherical surface, or a combination of circular dimple and non-circular dimple may be arranged thereon. Particularly, when the non-circular dimple such as triangle, rectangle or the like capable of sufficiently developing the function inherent to the dimple is properly arranged in that portion which can not form a circular dimple of minimum size, the occupying ratio of dimples in the spherical surface and the arranging density thereof can be more increased.

Although the illustrated embodiments have been described with respect to the icosahedron as a basic form, the same dimple arrangement may be applied to the other regular polygon as a basic form, or the dimples may be directly formed on the spherical surface represented by cylindrical coordinates at given respective positions without taking the regular polygon as a basic form.

As mentioned above, according to the invention, the dimples are formed on all great circles depicted on the spherical surface thereof, whereby the formation of ring-like island portion can completely be prevented in the golf ball. Thus the aerodynamic properties of the golf ball are not only improved but also sufficiently uniformized over the full spherical surface. As a result, the flying distance of the golf ball is increased and the accidental turning thereof is effectively prevented.

What is claimed is:

1. A golf ball having a plurality of dimples formed in its spherical surface, characterized in that all of said dimples are arranged in a dimple pattern on all great circles depicted on said spherical surface.

2. The golf ball according to claim 1, wherein said dimple pattern is arranged on said surface so that there is no ring-like island portion defining a parting line on said spherical surface.

3. The gold ball of claim 1 wherein said dimple pattern comprises 272 dimples.

4. The golf ball of claim 2 wherein said dimples are circular.

5. The golf ball of claim 1 wherein said dimple pattern comprises 372 circular dimples.

6. The golf ball of claim 1 wherein said dimple pattern comprises 402 dimples.

7. The golf ball of claim 1 wherein said dimple pattern comprises 480 dimples.

8. The golf ball of claim 1 wherein said dimple pattern comprises 482 dimples.

* * * * *